United States Patent [19]

Nowak et al.

[11] Patent Number: 4,691,936

[45] Date of Patent: Sep. 8, 1987

[54] SKI BINDING, IN PARTICULAR FOR USE IN CROSS-COUNTRY SKIING

[75] Inventors: Gerhard Nowak, Biedermannsdorf; Alfred Winter; Hans P. Morbitzer, both of Vienna; Klaus Kruschik, Gumpoldskirchen; Rudolf Theuer, Trumau, all of Austria

[73] Assignee: TMC Corporation, Baar, Switzerland

[21] Appl. No.: 828,953

[22] Filed: Feb. 12, 1986

[30] Foreign Application Priority Data

Feb. 18, 1985 [AT] Austria ..... 474/85

[51] Int. Cl.[4] ..... A63C 9/00

[52] U.S. Cl. ..... 280/615

[58] Field of Search ..... 280/614, 615, 611, 626, 280/631

[56] References Cited

U.S. PATENT DOCUMENTS

| | | | |
|---|---|---|---|
| 4,082,312 | 4/1978 | Johnson | 280/615 |
| 4,303,259 | 12/1981 | Riikonen | 280/615 |
| 4,309,833 | 1/1982 | Salomon | 280/615 X |
| 4,382,611 | 5/1983 | Salomon | 280/615 |
| 4,438,947 | 3/1984 | Cooper | 280/615 |
| 4,533,154 | 8/1985 | Bernard et al. | 280/615 |
| 4,557,498 | 12/1985 | Bernhardson | 280/615 |

FOREIGN PATENT DOCUMENTS 0088673 9/1983 European Pat. Off. .

*Primary Examiner*—John J. Love
*Assistant Examiner*—Michael Mar
*Attorney, Agent, or Firm*—Flynn, Thiel, Boutell & Tanis

[57] ABSTRACT

A ski binding having a hook element arranged at the tip of a ski shoe, a bearing block secured to the ski and having a receiving part for the hook element, and a locking element supported on the bearing block and having at least one locking protuberance. The locking element locks the hook element against movement on the receiving part by means of a spring force. The hook element has a wall-like member or hook bar which extends in the skiing position at least approximately vertically upwardly relative to the upper side of the ski. The receiving part has guide bars thereon which extend approximately perpendicularly to the upper side of the ski and which are designed to receive the hook bar therein. In order to reduce in this ski binding the number of necessary structural parts and to simplify the entire design of the ski binding, the invention provides that the hook bar at its lower region and its upper region is connected by means of two elastic web members to the tip of the shoe, and that the receiving part is fixedly connected to the bearing block.

8 Claims, 4 Drawing Figures

SKI BINDING, IN PARTICULAR FOR USE IN CROSS-COUNTRY SKIING

FIELD OF THE INVENTION

The invention relates to a ski binding, in particular for use in cross-country skiing.

BACKGROUND OF THE INVENTION

Ski bindings for use in cross-country skiing can already be obtained in the marketplace (see European Patent Office publication No. 0088673). The bearing block and receiving part are, in the known and comparable ski binding, two separate structural parts, namely a part which is secured to the ski by screws and a part which is hinged to the bearing block and on which the hook element is releasably secured. All together four structural parts must be manufactured for the known and comparable ski binding.

Other known ski bindings for use in cross-country skiing (see German OS No. 29 42 806 which corresponds to U.S. Pat. No. 4,309,833 and German Pat. No. 30 02 874 which corresponds to U.S. Pat. No. 4,382,611) have the disadvantage that the locking element is constructed as a hand lever, which both during a stepping of a skier into the binding and also during a stepping out of the binding can be pivoted only by a complete bending over of the skier. This, however, takes much effort, and in particular older persons at times have difficulty in bending over after long periods of cross-country skiing.

Finally, Austrian Pat. No. 371 016 (which corresponds partly to U.S. Pat. No. 4,303,259) describes a ski binding for use in cross-country skiing, in which the hook element is formed by the extended sole of the shoe. The ski binding has the disadvantage that the ski shoe must be guided in longitudinal direction of the ski into the bearing block which is secured on the ski, which can cause a sliding away of the ski during the stepping-in procedure.

The purpose of the invention is to overcome the disadvantages of all known designs and to provide a ski binding, in particular for use in cross-country skiing, in which the number of structural parts is reduced, in which not the receiving part, but the hook element makes possible the pivotal movement of the ski shoe needed for cross-country skiing.

The purpose is inventively attained by providing an elastic member between the ski shoe and a receiving part on a bearing block fastened to the ski. A separate receiving part and thus also a separate joint for same is no longer needed in this construction. Thus, not only the number of the structural parts is limited, but the entire design of the ski binding is simplified.

The hook element could actually—viewed from the side—have a rectangular form. For reasons of sturdiness, however, it has proven to be inventively advantageous to construct the hook element approximately O-shaped when viewed in a side view, and with the lower web member being connected to the shoe sole and the upper web member being connected to the tip of the shoe.

The possibility exists that at least the lower web member is constructed in one piece with the sole of the shoe. This makes a gluing of the lower web member to the shoe sole unnecessary, and the manufacture of the ski binding is thereby simplified.

Various possibilities are offered for the design of the locking element. A preferred embodiment is distinguished by the locking element being constructed approximately Z-shaped, with one leg of the Z being held by the bearing block, the intermediate web portion thereof having a locking protuberance thereon and the other leg functioning as an opening lever. It has been proven to be advantageous, when the elastic portion of the locking element extends between the leg which is secured to the bearing block and the intermediate web portion. This characteristic may make it possible to do without a separate spring for urging the locking element into the locking position.

In another embodiment, the locking element is constructed as a two-arm lever, one lever arm of which has the locking protuberance thereon and the other lever arm of which engages the spring. The locking element is supported on the bearing block. In this embodiment, the locking element can have a spur which grips beneath the shoe sole. This enables both a stepping into the binding and also a stepping out of the binding to be made easier.

BRIEF DESCRIPTION OF THE DRAWINGS

Two exemplary embodiments of the inventive ski bindings are illustrated in the drawings, in which.

DETAILED DESCRIPTION

Figure 1:
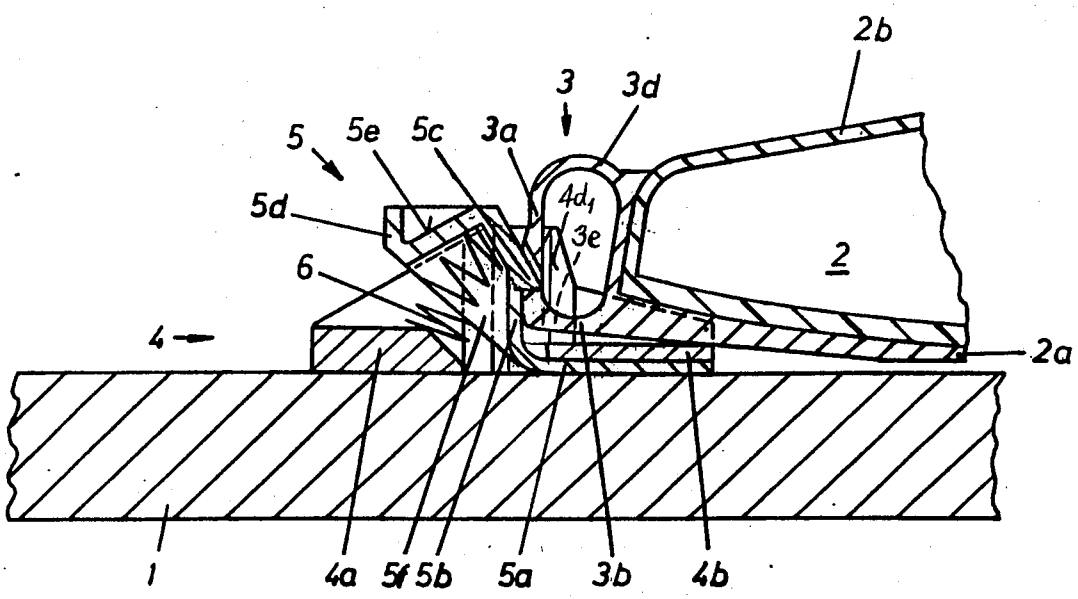
FIG. 1 is a cross-sectional view taken along the line I—I of FIG. 2 of a ski binding in skiing position and according to a first exemplary embodiment.

The ski is identified by the reference numeral 1 and the shoe by the reference numeral 2 in the drawings. The sole of the shoe is identified by the reference numeral 2*a* and the tip thereof by the reference numeral 2*b*. The ski binding itself consists of three parts, namely, a hook element 3 which is mounted on the ski shoe 2, a bearing block 4 having a receiving part for the hook element 3 and a locking element 5.

Figure 2:
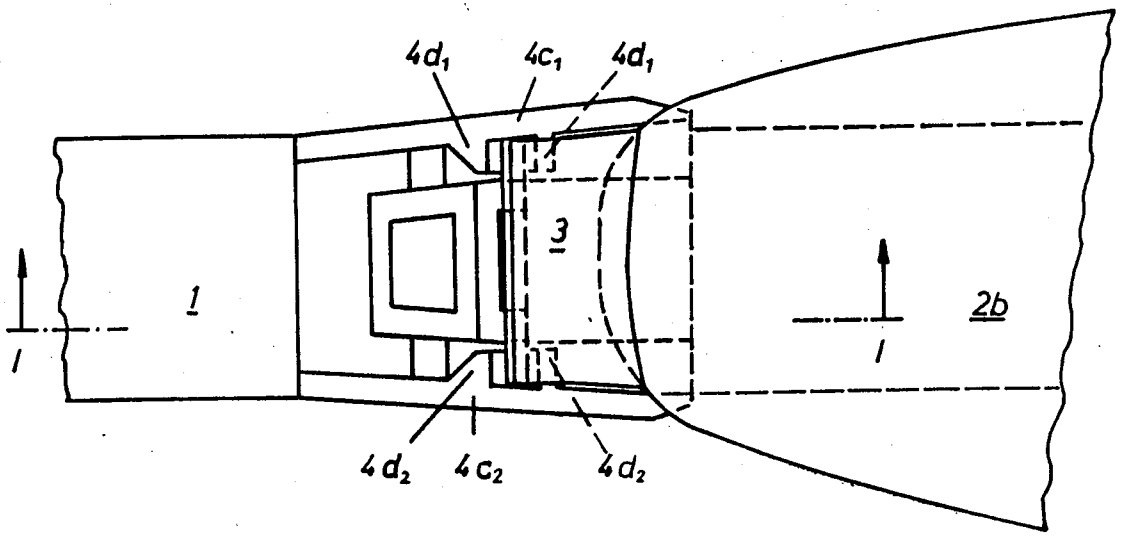
FIG. 2 is a top view of the ski binding.

The hook element 3 is constructed approximately O-shaped when viewed from the side as shown in FIG. 1. The O-shaped hook element 3 has a frontmost and laterally extending hook bar or wall-like member 3*a* which extends in the normal position thereof at least approximately vertically relative to the upper side of the ski 1. A lower web member 3*b* of the hook element 3 is made of an elastic material, such as rubber, plastic or the like, and is connected between the lower portion of the hook bar 3*a* and the shoe sole 2*a*. A notch 3*e* (FIGS. 1 and 2) is provided in each lateral edge of the lower web member 3*b*. Furthermore, the upper portion of the hook bar 3*a* is connected through an upper web member 3*d*, which also is made of an elastic material, to the tip of the shoe 2*b*.

The bearing block 4 is secured to the upper side of the ski 1 by not illustrated screws. It has a section 4*a* which extends toward the tip of the ski and which serves as an abutment or support for one end of a pressure spring 6, the other end of which rests on a web member 5*b* of the locking element 5. The locking element 5 is, as shown in FIG. 1, Z-shaped in the side view. A section 4*b* of the bearing block 4 extends adjacent to and beneath the tip of the shoe 2*b*. The section 4*b* is spaced from the upper side of the ski 1. One leg 5*a* of the locking element 5 extends into the space between the upper side of the ski 1 and the section 4*b*. The hook element 3 is received in a receiving part on the bearing block 4, which receiving part has two sidewalls $4c_1$ and $4c_2$. These two sidewalls diverge toward the tip of the shoe 2*b* and have on their inner sides, guide bars $4d_1$ and $4d_2$ which straddle the open ends of the wall-like hook bar 3*a*. Since, as had already been discussed, the two webs 3*b* and 3*d* of the hook element 3 are made of an elastic material, the tip of the shoe 2*b* and with it the ski shoe 2 can be swung through a predetermined angle relative to the ski 1.

Figure 3:
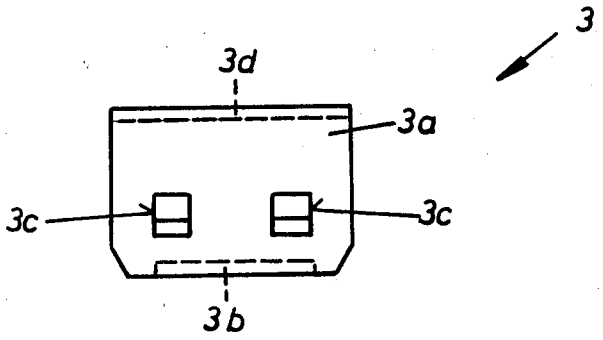
FIG. 3 is a front view of a hook element.

The locking element 5 is also made of an elastic material, for example a flat spring steel bent to the Z-shape or a plastic. As stated above, one leg 5*a* of the locking element 5 is clamped between the section 4*b* of the bearing block 4 and the upper side of the ski 1. The web 5*b* of the Z has two locking protuberances 5*c* designed for entering rectangular-shaped recesses 3*c* (FIG. 3) in the front wall-like member or hook bar 3*a* of the hook element 3. An elastic hinged connection is provided between the leg 5*a* and the web 5*b*. Furthermore, the web 5*b* of the locking element 5 is also subjected, aside from the influence of its own elasticity to the influence of the already mentioned pressure spring 6 acting on the web 5*b*. The web 5*b* is reinforced by sidewalls 5*f*, which at the same time form a guideway for the pressure spring 6. A shoulder 5*d* is connected to the end of the web 5*b* remote from the leg 5*a* and extends away from the tip of the shoe 2*b*. A recess 5*e* is provided in the shoulder 5*d* for facilitating an insertion of the tip of a ski pole for the purpose of opening the ski binding.

The ski binding assumes in the gliding position or gliding phase the position illustrated in FIG. 1. The hook bar 3*a* of the hook element 3 is held by the locking protuberances 5*c* of the locking element 5 relative to the ski 1.

If the skier now carries out a cross-country skiing step, the tip of the shoe 2*b* and with it the ski shoe 2 is then swung or pivoted counterclockwise. The hook bar 3*a* is laterally supported by the guide bars $4d_1$, $4d_2$ in the receiving part of the bearing block 4 with the help of the locking protuberances 5*c* on the locking element 5. The two webs 3*b* and 3*d* on the hook element 3 are elastically deformed during the swinging or pivoting movement of the foot in the counterclockwise direction in FIG. 1. The counterclockwise swinging movement of the shoe 2 can occur until the tip of the shoe 2*b* engages the rearmost guide bars $4d_1$ and $4d_2$. After the cross-country skiing step is finished, the ski shoe 2 returns again clockwise into the position which is illustrated in FIG. 1.

If the ski binding is to be opened, then the tip of the ski pole is inserted into the recess 5*e* of the locking element 5, so that the shoulder 5*d* and with it the web 5*b* can be swung counterclockwise against the force of the pressure spring 6 and the elasticity of the locking element 5. The two locking protuberances 5*c* are thus removed from the associated recesses 3*c* in the hook bar 3*a* of the hook element 3, and the ski shoe can be removed together with the hook element 3 upwardly and away from the bearing block 4.

During re-entry of the shoe into the ski binding, the hook bar 3*a* is reintroduced in a vertical direction between the rear guide bars $4d_1$ and $4d_2$ and the web 5*b* of the locking element 5. The rearmost guide bars $4d_1$ and $4d_2$ are received in the notch 3*e*. The web 5*b* is thereby slightly urged forwardly against the force of the pressure spring 6 and the elasticity of the locking element 5 until the two locking protuberances 5*c* are received in the associated recesses 3*c* in the hook bar 3*a* of the hook element 3. This action causes the skiing position of the ski binding to again be achieved.

Figure 4:
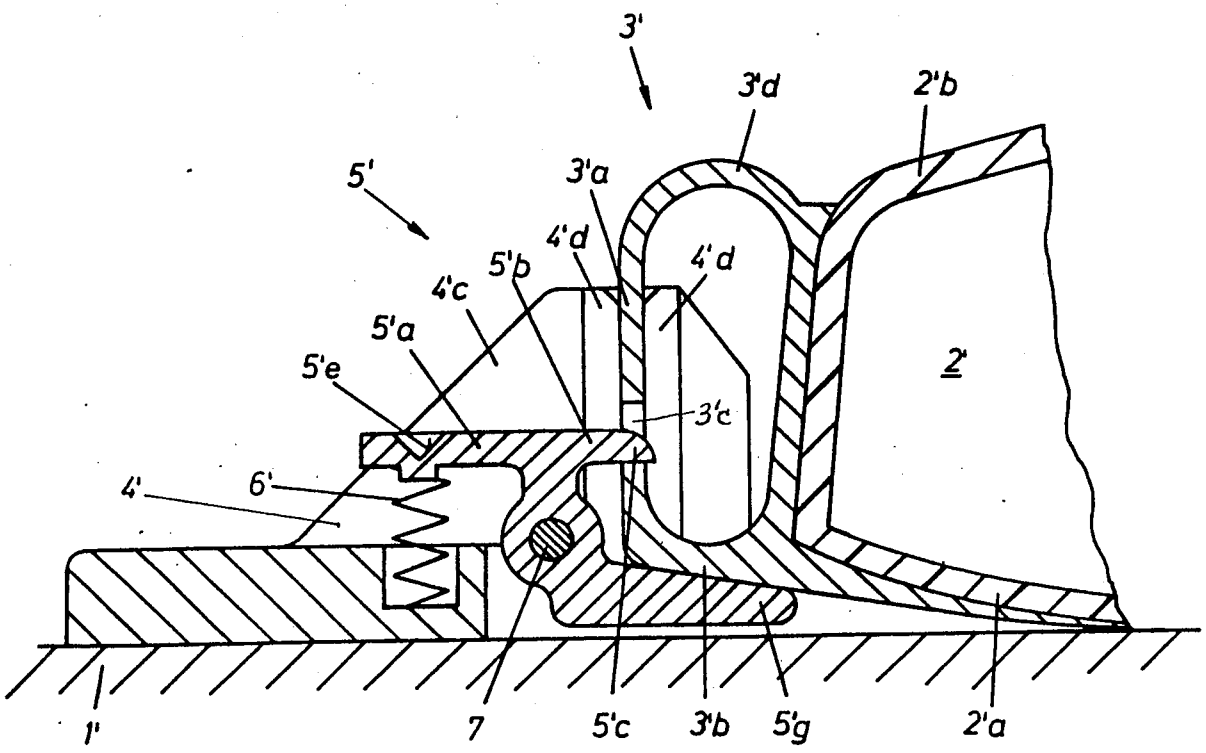
FIG. 4 is an enlarged vertically central longitudinal cross-sectional view of a second embodiment of the inventive ski binding.

In the exemplary embodiment according to FIG. 4, the ski is identified by the reference numeral 1' and the shoe by the reference numeral 2'. Reference numeral 2'*a* references the sole and reference numeral 2'*b* references the tip of the shoe 2'. The hook element 3' is approximately O-shaped in the side view. The hook bar 3'*a* is connected through an elastic lower web member 3'*b* to the shoe sole 2'*a* and through an elastic upper web member 3'*d* to the tip of the shoe 2'*b*.

A bearing block 4' is connected by means of not illustrated screws to the upper side of the ski 1'. The bearing block 4' appears as a fork-shaped or bifurcated receiving part when viewed in a top view. One end of a pressure spring 6' is anchored in a bore on the bearing block 4'. The other end of the pressure spring 6' engages one leg 5'*a* of a locking element 5'. The locking element 5' is pivotally supported on an axle 7 in the bearing block 4'. The bifurcated receiving part of the bearing block 4' has two laterally spaced sidewalls 4'*c* which have on their inner sides guide bars 4'*d* operatively engageable with the hook bar 3'*a*.

In the embodiment illustrated in FIG. 4, the locking element 5' is constructed as a three-arm lever. A first leg 5'*a* of the lever arm has already been explained, namely, it is abutted against the other end of the pressure spring 6. The first leg also has a recess 5'*e* on a side opposite the spring designed to receive therein the tip of a ski pole. A second leg 5'*b* has at least one locking protuberance 5'*c* thereon receivable in a recess 3'*c* in the hook bar 3'*a*. A third leg 5'*g* is constructed as a spur and extends beneath the shoe sole 2'*a*.

The use of this ski binding corresponds substantially with the use of the first described exemplary embodiment. It differs from the first embodiment in that during a stepping into the ski binding, the locking element 5' is pressed by the shoe sole 2'*a* into the locking position and that during a stepping out of the ski binding, the shoe sole 2'*a* is lifted by the spur 5'*g*. This causes both the stepping-in procedure and the stepping-out procedure to be made easier.

Of course, the invention is by no means to be limited to the exemplary embodiments which are illustrated in the drawings and described above. Rather, various modifications of the same are possible without departing from the scope of the invention. For example, in place of a pressure spring, it would be possible for a rubber block to be secured to the bearing block and to the locking element by a vulcanization process, which rubber block performs the same function as the pressure spring. Furthermore, with a suitable elasticity of the locking element, the use of a separate pressure spring is not needed.

The inventive ski binding can be used not only for cross-country skiing, but also for the so-called touring skiing wherein the heel of the shoe is releasably locked to the ski. However, for this case a safety release, at least at the toe of the shoe, is not guaranteed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privlege is claimed are defined as follows:

1. A cross-country skiing assembly, comprising a bearing block secured to a ski, a ski shoe receiving part stationarily fixedly connected to a bearing block, a hook element provided on a toe portion of a ski shoe, a locking element supported on said bearing block and having at least one locking protuberance thereon said hook element is secured against movement on said receiving, said hook element including a hook bar which extends generally vertically to an upper surface of said ski in front of said toe portion and having means thereon operatively engaged by said locking protuberance, a spring means yieldably urging said locking element into operative locking relation with said hook bar, said receiving part having at least, in a skiing position, guide bars operatively engaging said hook element, said guide bars extending approximately perpendicularly to an upper side of said ski and project inwardly from said receiving part, and a pair of elastic web members, one of said web members being connected to and extending between a top part of said toe portion of said ski shoe and a top part of said hook bar, and the other of said web members being connected to and extending between a bottom part of said toe portion of said ski shoe and a bottom part of said hook bar, said web members both being elastically yieldable in response to a movement of said ski shoe relative to said ski.

2. The cross-country skiing assembly according to claim 1, wherein said locking element is constructed approximately Z-shaped, one leg of said Z-shaped locking element being held by said bearing block, said intermediate web having said locking protuberance thereon and a remaining leg defining an opening lever.

3. The cross-country skiing assembly according to claim 2, wherein said spring means is provided between a leg secured to said bearing block and said intermediate web.

4. The cross-country skiing assembly according to claim 1, wherein said locking element is a two-arm lever, one lever arm thereof having thereon said locking protuberance and a remaining lever arm operatively engaging said spring means, and wherein said locking element is supported on said bearing block.

5. The cross-country skiing assembly according to claim 4, wherein said locking element has a spur which grips under a sole portion of said shoe.

6. The cross-country skiing assembly according to claim 1, wherein said guide bars are stationarily fixed to said receiving part.

7. The cross-country skiing assembly according to claim 1, wherein said hook element is approximately O-shaped when viewed in a side view.

8. The cross-country skiing assembly according to claim 7, wherein at least said lower web member is constucted in one piece with said sole of said shoe.

* * * * *

UNITED STATES PATENT AND TRADEMARK OFFICE

CERTIFICATE OF CORRECTION

PATENT NO. : 4 691 936

DATED : September 8, 1987

INVENTOR(S) : Gerhard NOWAK et al

It is certified that error appears in the above-identified patent and that said Letters Patent is hereby corrected as shown below:

Column 5, line 9; delete "said hook".

Column 5, line 10; delete "element is secured against movement on said receiving".

Signed and Sealed this

Second Day of February, 1988

*Attest:*

DONALD J. QUIGG

*Attesting Officer*

*Commissioner of Patents and Trademarks*